US009068282B2

(12) United States Patent
Cannizzaro et al.

(10) Patent No.: US 9,068,282 B2
(45) Date of Patent: Jun. 30, 2015

(54) SYSTEM AND METHOD FOR MAKING BIOMATERIAL STRUCTURES

(75) Inventors: Christopher Cannizzaro, Washington, DC (US); Michael L. Lovett, Peabody, MA (US); Gordana Vunjak-Novakovic, New York, NY (US); David L. Kaplan, Concord, MA (US)

(73) Assignees: Trustees of Tufts College, Medford, MA (US); The Trustees of Columbia University in the City of New York, New York, NY (US)

( * ) Notice: Subject to any disclaimer, the term of this patent is extended or adjusted under 35 U.S.C. 154(b) by 649 days.

(21) Appl. No.: 12/934,666

(22) PCT Filed: Apr. 8, 2009

(86) PCT No.: PCT/US2009/039870

§ 371 (c)(1),
(2), (4) Date: Dec. 6, 2010

(87) PCT Pub. No.: WO2009/126689

PCT Pub. Date: Oct. 15, 2009

(65) Prior Publication Data

US 2011/0076384 A1 Mar. 31, 2011

Related U.S. Application Data

(60) Provisional application No. 61/043,343, filed on Apr. 8, 2008.

(51) Int. Cl.
*D01D 10/00* (2006.01)
*D01F 4/02* (2006.01)

(Continued)

(52) U.S. Cl.
CPC .. *D01F 4/02* (2013.01); *D01D 5/06* (2013.01); *D01D 5/18* (2013.01); *D01D 7/00* (2013.01); *D01D 5/04* (2013.01)

(58) Field of Classification Search
USPC ..... 264/28, 85, 211.12, 211.14, 338, 465, 264/211.1; 425/66, 174.8 E, 377, 378.2, 425/380, 461
See application file for complete search history.

(56) References Cited

U.S. PATENT DOCUMENTS 4,916,193 A * 4/1990 Tang et al. ..... 525/413
5,252,285 A * 10/1993 Lock ..... 264/202

(Continued)

FOREIGN PATENT DOCUMENTS

GB 321762 A * 11/1929
WO 2006/068838 A2 6/2006

(Continued)

OTHER PUBLICATIONS

Baguneid, M.S. et al., Br J Surg, 93:282-290 (2006). "Tissue engineering of blood vessels.".

(Continued)

*Primary Examiner* — Leo B Tentoni
(74) *Attorney, Agent, or Firm* — Choate, Hall & Stewart, LLP; Brian E. Reese

(57) ABSTRACT

A system and method for making a biomaterial device includes a support structure providing a shape for a biomaterial device. At least one applicator has a supply of biomaterial solution and is positioned along the support structure. The at least one applicator forms a biomaterial fiber by applying shear force to the biomaterial solution and delivering the biomaterial fiber to the support structure. A controller causes relative movement between the support structure and the at least one applicator, and the biomaterial fiber is arranged on the support structure according to the relative movement to form the biomaterial device. The biomaterial may be silk fibroin which may be wound onto a reciprocating and rotating mandrel. Control over the properties of the biomaterial device is achieved through appropriate selection of material processing, winding strategy, and post-winding processing.

18 Claims, 3 Drawing Sheets

(51) Int. Cl.

| | |
|---|---|
| ***D01D 5/06*** | (2006.01) |
| ***D01D 5/18*** | (2006.01) |
| ***D01D 7/00*** | (2006.01) |
| ***D01D 5/04*** | (2006.01) |

(56) References Cited

U.S. PATENT DOCUMENTS

| | | | | |
|---|---|---|---|---|
| 5,294,389 | A * | 3/1994 | Hain et al. | 264/85 |
| 6,197,240 | B1 * | 3/2001 | Pinchuk | 264/309 |
| 6,716,225 | B2 * | 4/2004 | Li et al. | 606/152 |
| 2002/0094514 | A1 * | 7/2002 | Bowlin et al. | 435/2 |
| 2003/0114061 | A1 * | 6/2003 | Matsuda et al. | 442/123 |
| 2003/0215624 | A1 * | 11/2003 | Layman et al. | 264/465 X |
| 2004/0102614 | A1 * | 5/2004 | Islam et al. | 530/353 |
| 2005/0139713 | A1 * | 6/2005 | Weber et al. | 242/418.1 |
| 2005/0276841 | A1 * | 12/2005 | Davis et al. | 424/443 |
| 2006/0085063 | A1 * | 4/2006 | Shastri et al. | 623/1.41 |
| 2006/0175727 | A1 * | 8/2006 | Fierens et al. | 264/172.19 |
| 2007/0038290 | A1 * | 2/2007 | Huang et al. | 623/1.16 |
| 2007/0225631 | A1 * | 9/2007 | Bowlin et al. | 602/52 |
| 2007/0269481 | A1 * | 11/2007 | Li et al. | 264/465 X |
| 2008/0118427 | A1 * | 5/2008 | Leon y Leon | 423/447.2 |
| 2008/0208325 | A1 * | 8/2008 | Helmus et al. | 623/1.44 |

FOREIGN PATENT DOCUMENTS

| | | | |
|---|---|---|---|
| WO | WO-2007016524 | A2 * | 2/2007 |
| WO | 2007/111811 | A2 | 10/2007 |

OTHER PUBLICATIONS

Fidkowski, C. et al., Tissue Eng, 11:302-309 (2005). "Endothelialized microvasculature based on a biodegradable elastomer.".

Isenberg, B.C. et al., Ann Biomed Eng, 34:971-985 (2006). "Endothelialization and flow conditioning of fibrin-based media-equivalents.".

Jain, R.K. et al., Nat Biotechnol, 23:821-823 (2005). "Engineering vascularized tissue.".

Kannan, R.Y. et al., Biomaterials, 27:4618-4626 (2006). "Polyhedral oligomeric silsequioxane-polyurethane nanocomposite microvessels for an artificial capillary bed.".

Lovett, M. et al., Biomaterials, 28:5271-5279 (2007). "Silk fibroin microtubes for blood vessel engineering.".

Niklason, L.E. et al., J Vasc Surg, 33:628-638 (2001). "Morphologic and mechanical characteristics of engineered bovine arteries.".

Remuzzi, A. et al., Tissue Eng, 10:699-710 (2004). "Vascular smooth muscle cells on hyaluronic acid: culture and mechanical characterization of an engineered vascular construct".

Soffer, L. et al., Journal of Biomaterials Science, Polymer Edition, 19:653 (2008). "Silk-based electrospun tubular scaffolds for tissue-engineered vascular grafts.".

Yang, Y. et al., Biomaterials, 28:5526 (2007). "Development and evaluation of silk fibroin-based nerve grafts used for peripheral nerve regeneration.".

International Search Report for PCT/US2009/039870, 4 pages (Jan. 4, 2010).

Written Opinion for PCT/US2009/039870, 6 pages (Jan. 4, 2010).

* cited by examiner

SYSTEM AND METHOD FOR MAKING BIOMATERIAL STRUCTURES

CROSS REFERENCE TO RELATED APPLICATIONS

This application is a 35 U.S.C. § 371 National Phase Entry application of International Application No. PCT/US2009/039870 filed on Apr. 8, 2009, which designates the United States, and which claims benefit under 35 U.S.C. § 119(e) of U.S. Provisional Application No. 61/043,343 filed Apr. 8, 2008, the contents of which are incorporated herein by reference in their entirety.

STATEMENT REGARDING FEDERALLY SPONSORED RESEARCH OR DEVELOPMENT

This invention was supported by Grant EB002520 awarded by the United States National Institutes of Health. The United States government has certain rights in the invention.

BACKGROUND OF THE INVENTION

1. Field of the Invention

The invention pertains to the field of biomaterial structures and, more particularly, to systems and methods that control the mechanical and biological properties of a biomaterial structure by controlling how the biomaterial is deposited to form the biomaterial structure.

2. Description of Related Art

The demand for tubular constructs for tissue engineering is high given the interest in microvascular grafts, nerve guides, and pre-vascularized tissues. Microvascular grafts are described, for example, by Baguneid, M. S. et al. Tissue engineering of blood vessels. *Br J Surg* (2006), 93:282-290; Kannan, R. Y. et al. Polyhedral oligomeric silsequioxane-polyurethane nanocomposite microvessels for an artificial capillary bed. *Biomaterials* (2006), 27:4618-4626; and Lovett, M. et al. Silk fibroin microtubes for blood vessel engineering. *Biomaterials* (2007), 28:5271-5279, the contents of these publications being incorporated herein by reference. Nerve guides are described, for example, by Yang, Y. et al. Development and evaluation of silk fibroin-based nerve grafts used for peripheral nerve regeneration. *Biomaterials* (2007), 28:5526, the contents of which are incorporated herein by reference. Pre-vascularized tissues are described, for example, by Jain, R. K. et al. Engineering vascularized tissue. *Nat Biotechnol* (2005), 23:821-823; and Fidkowski, C. et al. Endothelialized microvasculature based on a biodegradable elastomer. *Tissue Eng* (2005), 11:302-309, the contents of these publications being incorporated herein by reference.

In order to form vessels with desired properties for a given application, a system is required that can functionally control parameters and processing techniques to reproducibly manufacture tubes with relevant properties. To date, vessels have been commonly made using biodegradable scaffolds and tubular molds, methods where the scaffold deposition is accomplished without control of polymer or fiber alignment, or by electrospinning, which requires optimization of several processing steps (e.g., mandrel selection, voltage, and humidity). The use of biodegradable scaffolds is described, for example, by Niklason, L. E. et al. Morphologic and mechanical characteristics of engineered bovine arteries. *J Vasc Surg* (2001), 33:628-638; and Remuzzi, A. et al. Vascular smooth muscle cells on hyaluronic acid: culture and mechanical characterization of an engineered vascular construct. *Tissue Eng* (2004), 10:699-710, the contents of these publications being incorporated herein by reference. The use of tubular molds is described, for example, by Isenberg, B. C. et al. Endothelialization and flow conditioning of fibrin-based media-equivalents. *Ann Biomed Eng* (2006), 34:971-985, the contents of which are incorporated herein by reference. The use of electrospinning is described, for example, by Soffer, L. et al. Silk-based electrospun tubular scaffolds for tissue-engineered vascular grafts. *Journal of Biomaterials Science, Polymer Edition* (2008), 19:653, the contents of which are incorporated herein by reference.

SUMMARY OF THE INVENTION

Tubular vessels for tissue engineering are typically fabricated using a molding, dipping, or electrospinning technique. These techniques, however, lack the ability to align the polymers or fibers of interest throughout the tube. The importance of aligned protein polymers and fibers in extracellular matrix structure permeates almost all tissue structures and provides an architectural basis for tissue function. An ability to reproduce aspects of this structural organization in biomaterial constructs allows the constructs to mimic native tissue features. Accordingly, embodiments according to aspects of the present invention provide systems and methods that control the mechanical and biological properties of a biomaterial structure by controlling how the biomaterial is deposited to form the biomaterial structure.

In particular, embodiments according to aspects of the present invention provide a method for making a biomaterial device. The method includes positioning at least one applicator along a support structure; generating, with the at least one applicator, a biomaterial fiber by applying shear forces to a biomaterial solution; delivering, with the at least one applicator, the biomaterial fiber to the support structure; and creating relative motion between a support structure and the at least one applicator. In this method, the relative motion between the support structure and the at least one applicator determines the arrangement of the biomaterial fiber on the support structure.

Correspondingly, embodiments according to aspects of the present invention provide a system for making a biomaterial device. The system includes a support structure providing a shape for a biomaterial device; at least one applicator having a supply of biomaterial solution and positioned along the support structure, the at least one applicator forming a biomaterial fiber by applying shear force to the biomaterial solution and delivering the biomaterial fiber to the support structure; and a controller causing relative movement between the support structure and the at least one applicator. In this system, the biomaterial fiber is arranged on the support structure according to the relative movement.

For example, embodiments may form a biomaterial device from a natural biopolymer, such as silk fibroin, which offers unique and robust mechanical properties along with versatile processing options to permit the formation of a desired structure. Such embodiments may form silk tubes by spinning silk fibers from a syringe or similar device and winding the silk fibers onto a reciprocating and rotating mandrel. These embodiments provide excellent control over tube properties through appropriate selection of silk processing, winding strategy, and post-winding processing. For example, the pattern by which the silk fibers are wound onto the mandrel and the resulting structure of the silk tube may be determined by varying the axial slew rate and rotation of the mandrel. Moreover, the structure of the silk tube may also be determined by post-winding processing steps, such as a methanol treatment step, a gas drying step, and/or a lyophilization step.

These and other aspects of the present invention will become more apparent from the following detailed description of the preferred embodiments of the present invention when viewed in conjunction with the accompanying drawings.

DETAILED DESCRIPTION

Figure 1:
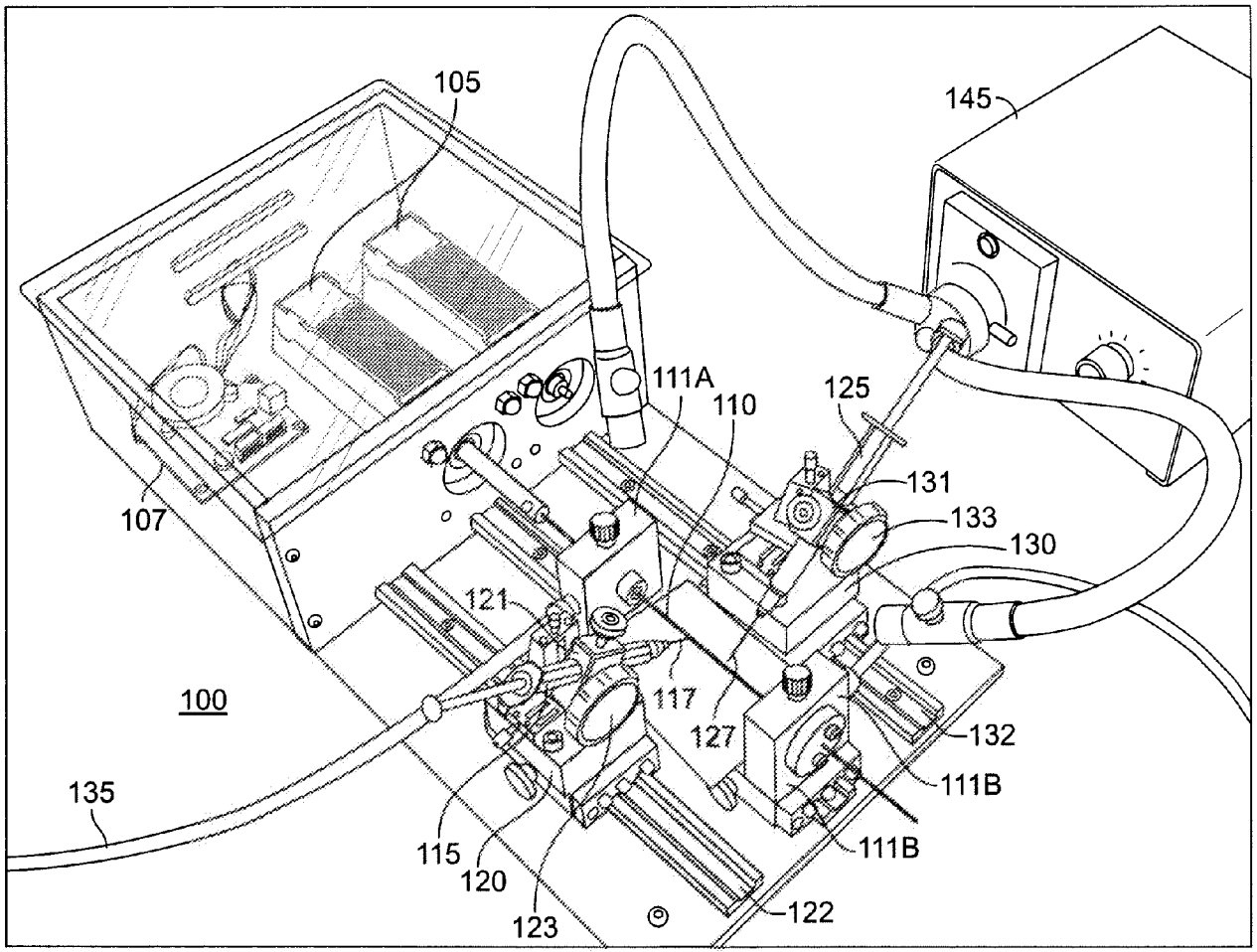
FIG. 1 illustrates an assembly for making a biomaterial structure according to aspects of the present invention.

Embodiments according to aspects of the present invention provide systems and methods that control the mechanical and biological properties of a biomaterial structure by controlling how the biomaterial is deposited to form the biomaterial structure. The importance of aligned protein polymers and fibers in extracellular matrix structure permeates almost all tissue structures and provides an architectural basis for tissue function. See, e.g., Sanchez, C. et al. Biomimetism and bio-inspiration as tools for the design of innovative materials and systems. *Nat Mater* (2005), 4:277-288; Giraud Guille, M. M. et al. Bone matrix like assemblies of collagen: from liquid crystals to gels and biomimetic materials. *Micron* (2005), 36:602-608; Moutos, F. T. et al. A biomimetic three-dimensional woven composite scaffold for functional tissue engineering of cartilage. *Nat Mater* (2007), 6:162-167; and Altman, G. H. et al. Silk-based biomaterials. *Biomaterials* (2003), 24:401-416, the contents of these publications being incorporated herein by reference. Thus, an ability to reproduce aspects of this structural organization in biomaterial constructs allows the constructs to mimic native tissue features.

In an example application, embodiments may spin a fiber from a silk fibroin aqueous solution and apply the fiber to a reciprocating and rotating mandrel to form silk tubes that can be used to repair blood vessels and the like. The properties of the silk tube, including the fiber alignment, are determined according to the processing of the silk fibroin aqueous solution, the application of the solution to the mandrel, and the processing of silk fibers after they are applied to the mandrel.

The use of silk tubes for blood vessel repair, for example, provides several advantages over existing scaffold materials/designs. See, e.g., Lovett, M. et al. Silk fibroin microtubes for blood vessel engineering. *Biomaterials* (2007), 28:5271-5279. These advantages are based upon the unique properties of silk fibroin, specifically its mechanical strength and toughness, as well as the ease of tube production using a simple dipping technique. See, e.g., Altman, G. H. et al. Silk-based biomaterials. *Biomaterials* (2003), 24:401-416, the contents of which are entirely incorporated herein by reference. In addition, as a protein, silk can be chemically modified with functional groups to serve specific functions. The simplicity of the known dipping technique, however, does not allow for fine control over tube wall thickness, uniformity, and pore size/distribution. See, e.g., Lovett, M. et al. Silk fibroin microtubes for blood vessel engineering. *Biomaterials* (2007), 28:5271-5279. Embodiments of the present invention, however, substantially improve silk properties and resultant tube properties by spinning a fiber from the aqueous silk solution and winding the fiber around a mandrel that reciprocates and rotates in a predetermined manner.

Gel spinning processes have been previously used to form uniform tubes or fibers from polymers such as poly(L-lactide-co-caprolactone) (PLCL), chitosan, and gelatin, among others. See, e.g., Kim S. H. et al. Fabrication of a new tubular fibrous PLCL scaffold for vascular tissue engineering. *J Biomater Sci Polym Ed* (2006), 17:1359-1374; Notin L. et al. Morphology and mechanical properties of chitosan fibers obtained by gel-spinning: influence of the dry-jet-stretching step and ageing. *Acta Biomater* (2006), 2:387-402; and Fukae R. et al. Gel-spinning and drawing of gelatin. *Polymer* (2005), 46:11193-11194, the contents of these publications being entirely incorporated herein by reference. These polymers, however, are spun using non-aqueous solvents and do not provide control over fiber alignment and orientation as achieved with the embodiments of the present invention.

Driving the silk through a small gauge needle induces a shear stress upon the amorphous concentrated fibroin (silk I), which helps to exclude water from the protein solution, align the silk fibrils, and induce silk II (antiparallel β-sheet, aqueous insoluble) structure. See, e.g., a Jin H. J. et al. Bioprocessing of Silk Proteins—Controlling Assembly. in: *Bionanotechnology* (Springer, Netherlands, 2006), pp. 189-208; and Xie F. et al. Effect of shearing on formation of silk fibers from regenerated Bombyx mori silk fibroin aqueous solution. *Int J Biol Macromol* (2006), 38:284-288, the contents of these publications being entirely incorporated herein by reference. This process mimics the process of protein spinning in the native silkworm, where fibroin concentration and physical shear play critical roles in the spinneret. See, e.g., Asakura T. et al. Some observations on the structure and function of the spinning apparatus in the silkworm Bombyx mori. *Biomacromolecules* (2007), 8:175-181, the contents of which are entirely incorporated herein by reference. According to aspects of the present invention, the spinning process allows properties such as winding pattern, pore size, and tube composition to be controlled, with further options during post-winding processing via treatment with methanol, air-drying, and/or lyophilization. Silk fibroin tubes generated by aspects of the present invention have applications within tissue engineering, from blood vessel grafts and nerve guidance channels to in vitro migration assays, permeability studies, and novel composite scaffolds in general.

Referring to FIG. 1, an assembly 100 for making a biomaterial structure according to aspects of the present invention is illustrated. As shown in FIG. 1, the assembly 100 includes a stepper motor 105 that is controlled by a controller board 107, or processing/computing device that can receive and execute programmed/stored instructions and send signals to operate the stepper motor 105. A fiber optic light source 145 is also provided.

Figure 2:
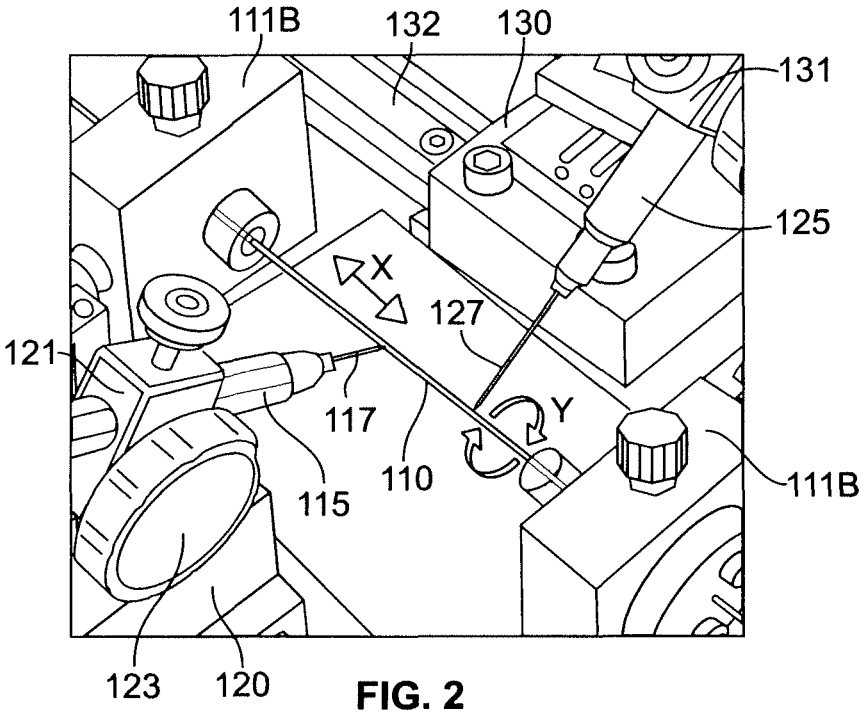
FIG. 2 illustrates another view of the reciprocating and rotating mandrel for the assembly of FIG. 1.

The stepper motor 105 is coupled to and, in combination with the controller board 107, controls a mandrel 110. The mandrel 110 extends longitudinally through two supporting guide blocks 111A and 111B. The guide blocks 111A and 111B may employ a synthetic fluoropolymer, such as Teflon® (polytetrafluoroethylene or polytetrafluoroethene (PTFE)), or the like, to allow the ends of the mandrel 110 to slide more freely through the guide blocks 111A and 111B. The stepper motor 105 causes the mandrel 110 to translate, or reciprocate, axially along its longitudinal axis and to rotate about its longitudinal axis. FIG. 2 illustrates axial translation X and rotation Y by the mandrel 110 with respect to other elements of the assembly 100. For example, rotational speeds may vary approximately from 0 to 200 rpm while axial speed may range approximately from 0 to 40 mm/s over a maximum stroke length of approximately 5 cm.

For example, the assembly 100 may be a custom silk spinning system designed with a standard CAD program (Solidworks, Concord, Mass.), with resultant parts machined from aluminum, Delrin®, and Teflon®. In addition, a Teflon®-coated stainless steel rod having a diameter of approximately 1 mm (McMaster-Carr, Atlanta, Ga.) may be used as a silk spinning mandrel 110. The silk spinning mandrel 110 may be coupled, with a coupling adapter, to the shaft of a two axis stepper motor 105 (Haydon Switch & Instrument, Waterbury, Conn.). Furthermore, the motor 105 may be driven through the use of the stepper motor controller board 107 (Peter Norberg Consulting, Ferguson, Mo.) and controlled through a custom program written in LabVIEW (National Instruments, Austin, Tex.). However, it is understood that the parts of the system 100 are not limited to these specific examples. For instance, the mandrel 110 may be formed from other suitable materials and may have other shapes, configurations, and/or dimensions.

As also shown in FIG. 1, a first syringe 115 filled with a biomaterial, such as a silk fibroin aqueous solution, is disposed along the mandrel 110. In general, the biomaterial in the first syringe 115 may include a wide range of polymers processed in aqueous or organic solvent system. Examples include silk (silkworm, spider, genetically engineered variants), collagens, fibrin, chitin/chitosan, polyhydroxyalkanoates, elastin, resilin, cellulose and related or modified biopolymers, as well as degradable synthetic polymers such as polylactic acid and polyglycolic acid.

A first syringe support 120 receives and adjustably positions the first syringe 115, so that a needle 117 of the first syringe 115 can deliver, or deposit, the biomaterial on the mandrel 110. The needle 117, for example, may have a gauge of 25 to 30 (inner diameter of about 150 μm), but is not limited to these dimensions. Furthermore, the first syringe support 120 includes a perpendicular positioning element 121 that positions the first syringe 115 perpendicularly with respect to the longitudinal axis of the mandrel 110. In addition, the first syringe support 120 translates axially on a first support guide 122 to position the needle 117 along a line parallel to the longitudinal axis of the mandrel 110. Furthermore, the first syringe support 120 includes a rotating element 123 that rotates the first syringe 115 about an axis parallel to the longitudinal axis of the mandrel 110 to adjust the angle of the needle 117 with respect to the mandrel 110.

Once the needle 117 is set in the desired position, the first syringe 115 remains generally fixed while the stepper motor 105 causes the mandrel 110 to translate axially and rotate relative to the needle 117 as shown in FIG. 2. By controlling the relative motion and operation of the first syringe 115, the biomaterial in the first syringe 115 may be delivered to the mandrel 110 according to a desired pattern as described in detail below. In general, the mandrel 110 is a support structure that receives the biomaterial and defines a shape for the structure formed from the biomaterial. In addition, although the relative motion between the first syringe 115 and the mandrel 110 in FIG. 1 is caused by the operation of the stepper motor 105, the relative motion can be alternatively or additionally caused by movement of the first syringe 115, for example, by another motor coupled to the first syringe 115.

FIG. 1 also illustrates a second syringe 125 filled with a second biomaterial or a treatment solution, such as methanol, and disposed along the mandrel 110. A second syringe support 130 receives and adjustably positions the second syringe 125, so that a needle 127 of the second syringe 125 can deliver the second biomaterial or treatment solution to the mandrel 110. The needle 127, for example, may have a gauge of 25 to 30 (inner diameter of about 150 μm), but is not limited to these dimensions. Furthermore, the second syringe support 130 may include a perpendicular positioning element 131 that positions the second syringe 125 perpendicularly with respect to the longitudinal axis of the mandrel 110. In addition, the second syringe support 130 may translate axially on a second support guide 132 to move the needle 127 parallel to the longitudinal axis of the mandrel 110. Furthermore, the second syringe support 130 may include a rotating element 133 that rotates the second syringe 115 about an axis parallel to the longitudinal axis of the mandrel 110 to adjust the angle of the needle 127 with respect to the mandrel 110. Once the needle 127 is set in the desired position, the second syringe 115 remains generally fixed while the stepper motor 105 causes the mandrel 110 to translate axially and rotate relative to the needle 127 as shown in FIG. 2. As with the first syringe 115, the relative motion between the second syringe 125 and the mandrel 110 can be alternatively or additionally caused by movement of the second syringe 125, for example, by another motor coupled to the second syringe 125.

Accordingly, with the first syringe 115 and the second syringe 125, the assembly 100 enables a dual syringe technique, where the second syringe 125 is filled with a second biomaterial and two different biomaterials may be applied to the mandrel 110 to form the same biomaterial structure. Alternatively, the second syringe 125 may be filled with a treatment solution, such as methanol, which is applied to the biomaterial structure that is formed from the biomaterial in the first syringe 115.

Figure 3:
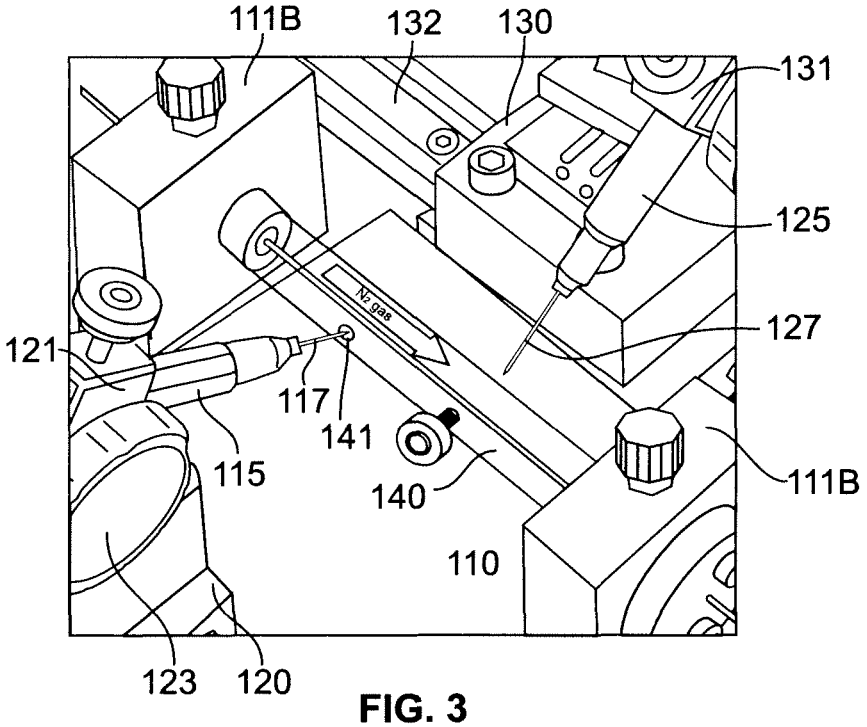
FIG. 3 illustrates a view of a tube enclosure for delivering drying gas to the mandrel for the assembly of FIG. 1.

Although FIGS. 1-3 may illustrate two syringes in the assembly 100, other embodiments may include any number of syringes, e.g., a single syringe or more than two syringes. In addition, while the first syringe support 120 and the second syringe support 130 shown in FIGS. 1-3 may position the needles 117 and 127, respectively, according to translation along two axes and rotation about one axis (three degrees of freedom), the first syringe support 120 and the second syringe support 130 may employ other configurations to move the needles 117 and 127 to a desired position with respect to the mandrel 110. Furthermore, embodiments according to aspects of the present invention are not limited to the use of syringes and may employ any delivery system that allows the biomaterial to be spun into a fiber and that allows the biomaterial to be deposited accurately onto the mandrel 110 according to a predetermined pattern. For example, embodiments according to aspects of the present invention may employ a robotics platform that programmatically delivers biomaterial through syringe pumps or through an array of needles that are coupled to reservoirs of biomaterial.

As shown in FIG. 1, a gas inlet tube 135 extends from a gas source (not shown) and is coupled to the guide block 111A to allow gas drying of the biomaterial applied to the mandrel 110. Additionally or alternatively, the gas inlet tube 135 may be coupled to the guide block 111B. As FIG. 3 illustrates, the mandrel 110 may be disposed within a tubing, or similar enclosure, 140 that extends between the guide blocks 111A and 111B and that allows the gas from the inlet tube 135 to flow along the mandrel 110 and dry the biomaterial applied to the mandrel 110. If the mandrel 110 has a diameter of approximately 1 mm, for example, ¼-inch (6.35 mm) tubing 140 may be employed. To provide the syringes 115 and 125 with access to the mandrel 110, the tubing 140 may include access holes 141 through which the needles 117 and 127 can extend into the tubing 140. The first syringe support 120 and the second syringe support 130 are operated as described previously to position the needles 117 and 127 in corresponding access holes 141.

As described previously, the first syringe 115 may contain a silk fibroin aqueous solution and the assembly 100 may be operated to deposit the silk fibroin aqueous solution onto the mandrel 110 to produce a biomaterial structure. In this example application, a 6-8% (w/v) silk fibroin aqueous solution may be obtained from Bombyx mori silkworm cocoons using procedures described by Kim, U. J. et al. Structure and properties of silk hydrogels. *Biomacromolecules* (2004), 5:786-792; and Li, C. et al. Electrospun silk-BMP-2 scaffolds for bone tissue engineering. *Biomaterials* (2006), 27:3115-3124, the contents of these publications being incorporated entirely herein by reference. For example, silkworm cocoons (Tajima Shoji Co., LTD., Yokohama, Japan) may be extracted in 0.02 M sodium carbonate solution, rinsed in distilled water, dissolved in 9.3 M lithium bromide, and dialyzed against distilled water using a Slide-a-Lyzer dialysis cassette (molecular weight cutoff MWCO, 3,500, Pierce, Rockford, Ill.) for 48 hours. The resulting 6-8% (w/v) fibroin solution is then concentrated by dialyzing against 10 wt % poly(ethylene glycol) (PEG) to produce a 20-30% (w/v) silk fibroin aqueous solution. The silk fibroin solutions are stored at 4° C. until used to make silk tubes.

Accordingly, the assembly 100 may be employed to produce silk tubes. For example, silk tubes may be prepared by pushing the 20-35% (w/v) silk fibroin solution through a 27 or 30 gauge needle 117 of the first syringe 115 onto the rotating and axially reciprocating mandrel 110. These parameters determine a shear rate, the ultimate driving force behind silk fibril alignment during the winding process. After evenly coating the mandrel 110 with concentrated silk fibroin, transformation from amorphous liquid to the β-form silk fibroin conformation characterized by anti-parallel β-sheets may be induced by treatment with methanol and/or drying under nitrogen gas. See, e.g., Wang, X. et al. Biomaterial coatings by stepwise deposition of silk fibroin. *Langmuir* (2005), 21:11335-11341, the contents of which are incorporated entirely herein by reference. Porous silk tubes may be formed with different winding patterns and different numbers of layers, creating tubes of altered pore size and distribution. Additional complexity in the silk tubes may be introduced by winding two or three different solutions in the same tubular construct. In one study, this technique was demonstrated by mixing fluorescent latex beads having diameter of approximately 10 μm (Invitrogen, Carlsbad, Calif.) or fluorescence-conjugated dextran or bovine serum albumin (50 μg/mL in silk) (Invitrogen, Carlsbad, Calif.) with the silk solutions and winding them as described previously and imaged using fluorescent microscopy. Under any tube formation technique, upon drying, the silk-coated mandrel is placed in a surfactant solution to remove the silk tube from the mandrel 110, e.g., a stainless steel rod coated with a synthetic fluoropolymer, such as Teflon®, or the like.

Thus, as described previously, the assembly 100 illustrated in FIG. 1 may provide a liquid silk spinning system that allows deposition of silk onto a reciprocating and rotating mandrel 110. Silk tubes of differing size may be formed by using a larger or smaller wire or rod for the mandrel 110. The assembly 100 provides unlimited control of winding parameters based not only on the range of rotational and axial speeds, but also through the use of offsets built into the program that can shift position of the silk with each successive stroke of the mandrel 110. This provides control of pore size and specific winding patterns, generating custom silk tubes based on the varied processing parameters.

Figure 4:
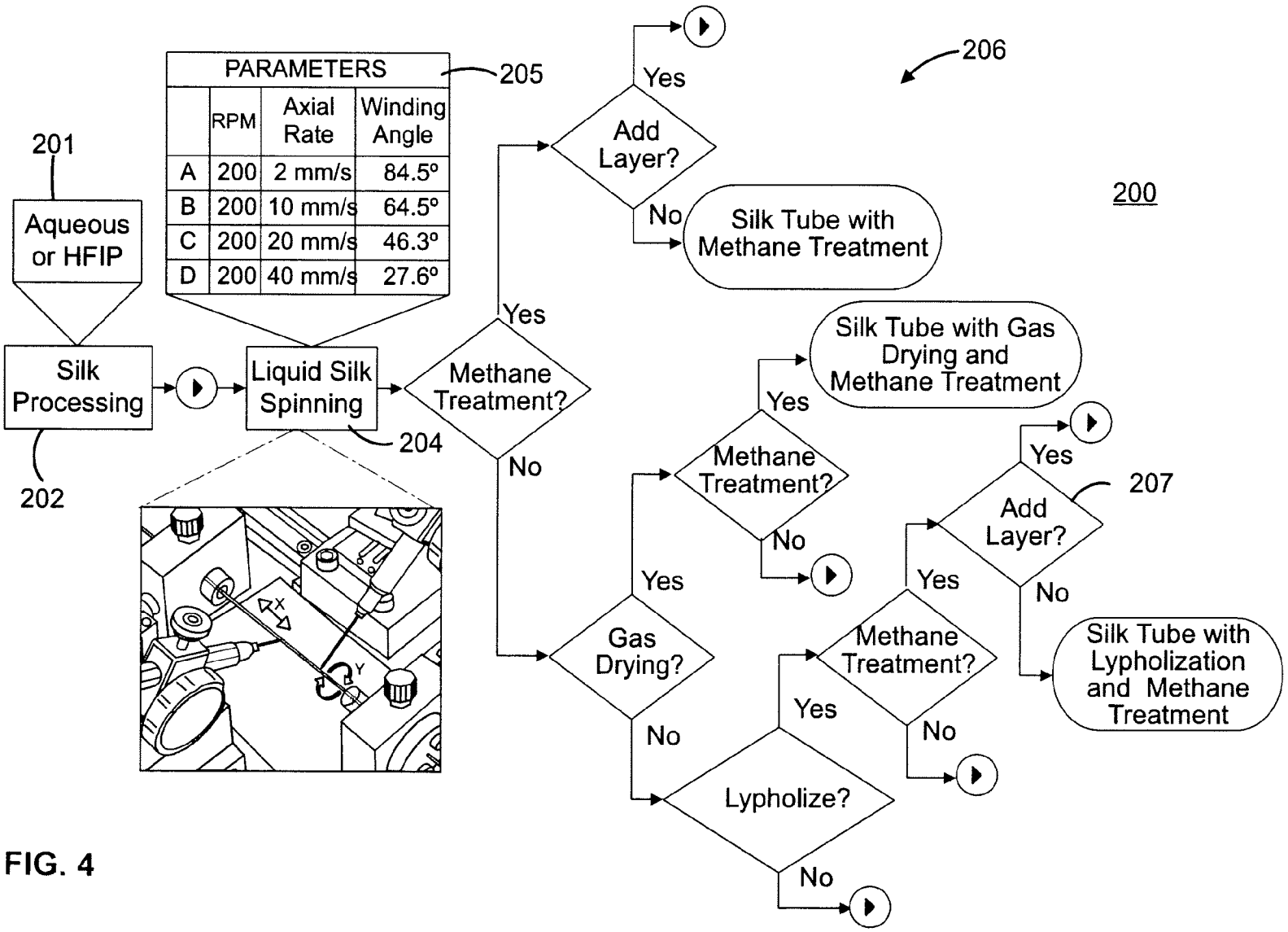
FIG. 4 illustrates a flowchart of steps for making a biomaterial structure according to aspects of the present invention.

Referring to FIG. 4, a flowchart 200 provides processing parameters and steps for making silk tube types with different properties. Specifically, processing parameters are defined at three different levels: a silk processing step 202, a liquid silk spinning step 204, and post-winding processing steps 206.

In the silk processing step 202, regenerated silk fibroin may be solubilized using an organic solvent (e.g., hexafluoro-2-propanol (HFIP)) or via an all aqueous process, 201. See, e.g., Nazarov, R. et al. Porous 3-D scaffolds from regenerated silk fibroin. *Biomacromolecules* (2004), 5:718-726; and Kim U. J. et al. Three-dimensional aqueous-derived biomaterial scaffolds from silk fibroin. *Biomaterials* (2005), 26:2775-2785, the contents of these publications being incorporated entirely herein by reference. While aqueous silk processing is discussed in more detail herein, substantially the same principles described with respect to all aqueous silk apply to HFIP-derived silk.

With a concentrated silk solution from the silk processing step 202, the liquid silk spinning step 204 deposits layers onto the mandrel 110 by winding the spun fibers onto the mandrel 110 according to chosen parameters 205. The execution of the liquid silk spinning step 204 as shown in FIG. 4 may correspond to the deposition of one layer of silk fiber on the mandrel 110. Thus, if additional layers are desired at step 207, the process returns to the liquid silk spinning process 204 where the same or different winding parameters and post-winding processing conditions may be chosen for subsequent layers until the desired final tube is formed.

Referring to the spinning parameters 205, a winding angle (θ) for the liquid silk spinning step 204 may be adjusted, for example, by varying the axial slew rate of the mandrel 110, while maintaining constant rotational speed. Any values for the axial slew rate and rotational speed may be employed to achieve the appropriate winding angle (θ), and these values may vary or remain constant during the deposition from the first syringe 115 and/or second syringe 225. The winding angle (θ) is defined as the angle of the spun silk to the horizontal plane of the mandrel 110 and is given by the equation:

$$\theta=\tan^{-1}(2\pi R V_{ROT}/V_{AXIAL}), \text{ where:}$$

R is the radius of the mandrel 110, e.g., 1 mm, $V_{ROT}$ is the revolutions per minute of the mandrel, e.g., 200 RPM, and $V_{AXIAL}$ is the linear velocity of the motor.

Referring to TABLE 1, four examples A, B, C, and D of winding parameters were selected in a study to demonstrate the control that can be achieved for liquid silk spinning 204.

TABLE 1

| | $V_{ROT}$ (RPM) | $V_{AXIAL}$ (mm/s) | θ (°) |
|---|---|---|---|
| A | 200 | 2 | 84.5 |
| B | 200 | 10 | 64.5 |
| C | 200 | 20 | 46.3 |
| D | 200 | 40 | 27.6 |

The parameters of winding A provided a simple wrapping, while the parameters of windings B, C, and D provided more complex crisscross designs. The silk winding fibers produced by the wrapping wind of example A were typically 404±31 μm in width. Meanwhile, the silk winding fibers produced by the crisscross winding patterns of examples B, C, and D were typically 177±74 μm in width. The differences in fiber spinning width relate back to the shear force applied to the silk by the needle 117 of the first syringe 115 in conjunction with the extrusion effect of the rotating and reciprocating mandrel 110. In the case of the crisscrossing patterns of windings B, C, and D, the movement of the mandrel 110 acts to draw out the silk, pulling and stretching the silk as it is sheared out of the needle. This force acts to thin out the fibers in a way not seen in the wrapping wind, which has a more negligible axial component, resulting in less fiber pulling and wider fiber diameters. It is noted that winding may be subject to failure at low silk concentrations due to inadequate shear for aligning silk fibrils, and at high concentrations due to pre-gelation in the syringe. See, e.g., Wang, H. et al. A study on the flow stability of regenerated silk fibroin aqueous solution. *Int J Biol Macromol* (2005), 36:66-70.

As shown further in FIG. 4, once the silk tube is wound on the mandrel 110, the silk tube may be subjected to post-winding processing steps 206. These post-winding processing steps 206 may include, for example, a methanol (MeOH) treatment step 1, a gas drying step 2, and a lyophilization step 3. As described previously, the second syringe 125 may contain a treatment solution, such as methanol, and may be operated to deliver the treatment solution as a post-winding processing step 206. In addition, the gas inlet tube 135 and the tubing 140 may be employed to deliver a drying gas, such as nitrogen, to the silk tube as another post-winding processing step 206. Furthermore, it is noted that post-winding processing steps 206 are not limited to those described herein. Indeed, rather than methanol, the treatment solution in the second syringe 125 may be ethanol, general alcohol, or the like. In addition, to stabilize the biomaterial applied to the mandrel 110, a variety of other post-winding processing steps may apply gases other than nitrogen, solutions with different pH values, crosslinking chemicals, and the like.

Combinations of the winding patterns in examples A, B, C, and D described previously and post-winding processing steps 1, 2, and 3 as shown in TABLE 2 provide at least twelve different approaches for forming a silk tube. A straightforward nomenclature system for describing each tube type may also be derived from TABLE 2. For example, a wound tube formed with a winding angle of 84.5° (e.g., $V_{AXIAL}$=2 mm/s, $V_{ROT}$=200 RPM) of example A above and subjected to the methanol treatment step 1 may be referred to as an A1 tube, while a tube made formed with a winding angle 46.3° (e.g., $V_{AXIAL}$=20 mm/s, $V_{ROT}$=200 RPM) and subjected to the lyophilization step 3 may be referred to as a C3 tube. Each different winding or post-winding processing step provides a particular measure of control over the resultant tube properties, allowing for composite tubes with different windings and post-winding processing techniques in one tube for more advanced applications.

TABLE 2

| | Post-winding Step 1 | Post-winding Step 2 | Post-winding Step 3 |
|---|---|---|---|
| Winding A | A1 tube: 84.5° winding angle with methanol treatment | A2 tube: 84.5° winding angle with gas drying | A3 tube: 84.5° winding angle with lyophilization |
| Winding B | B1 tube: 64.5° winding angle with methanol treatment | B2 tube: 64.5° winding angle with gas drying | B3 tube: 64.5° winding angle with lyophilization |
| Winding C | C1 tube: 46.3° winding angle with methanol treatment | C2 tube: 46.3° winding angle with gas drying | C3 tube: 46.3° winding angle with lyophilization |
| Winding D | D1 tube: 34.9° winding angle with methanol treatment | D2 tube: 34.9° winding angle with gas drying | D3 tube: 34.9° winding angle with lyophilization |

Studies showed that applying the methanol treatment step 1, the gas drying step 2, and/or the lyophilization step 3 had a significant impact on the final tube results. In post-winding processing, tubes that were subjected to methanol treatment step 1 were immediately induced into β-sheet formation, providing stability in the aqueous solution. See, e.g., Jin, H. J. et al. Mechanism of silk processing in insects and spiders. *Nature* (2003), 424:1057-1061. The methanol treatment step 1 conserved the outer morphology of the winding patterns as they were well defined throughout the length of the tube. However, the methanol treatment step 1 also induced a stratified structure within the tube as observed in tube cross-sections. Small gaps were clearly visible between each methanol-treated layer.

By applying the gas drying step 2, winding pattern morphology was less pronounced than with the methanol treatment step 1, a primary result of the layering of the silk tube. Cross-sections of air-dried silk tubes demonstrated a more compact structure between the layers which, in turn, created tubes that tended to be more brittle than their methanol-treated counterparts.

The application of the lyophilization step 3 gave the silk tubes a more porous, lamellar-like structure. Winding structure was typically obscured by the freeze-drying, and the tube surface roughness was increased, as was the tube flexibility. Lyophilized silk tubes have good potential for internal cell seeding as the multitude of interconnected pores allow significant cell ingrowth. In general, post-winding processing is an important component in the generation of tubes with defined properties.

Porous silk tubes may be generated by altering the axial slew rate, with rotational speed held constant, and by changing the number of layers deposited onto the mandrel 110. Offsets of approximately 1 mm, for example, may be introduced to control the spatial distribution of the silk and may be further altered for finer control of tube pore size and distribution. Pore spacing is controlled by the specific winding pattern used, where greater axial slew rates produce pores with greater center-to-center spacing. For example, using winding pattern B with winding angle 64.5° (e.g., $V_{AXIAL}$=10 mm/s, $V_{ROT}$=200 RPM), the pore center-to-center spacing was 1.57±0.06 mm, while using winding pattern C (e.g., $V_{AXIAL}$=20 mm/s, $V_{ROT}$=200 RPM), the pore center-to-center spacing was 3.73±0.06 mm. This pore spacing is substantially consistent over each number of strokes, indicating the fine control provided by the assembly 100. The pore size, meanwhile, is controlled by the number of strokes, where increasing the number of strokes produces tubes with smaller diameter pores.

Porous tubes may also be generated by the addition of poly(ethylene oxide) (PEO) to the silk, as described by Lovett, M. et al. Silk fibroin microtubes for blood vessel engineering. *Biomaterials* (2007), 28:5271-5279, or the alternate spinning of PEO and silk. For example, concentrated silk fibroin solutions may be blended with varying volumes of 6 wt % PEO to form blend ratios of silk fibroin/PEO. See, e.g., Jin, H. J. et al. Biomaterial films of Bombyx mori silk fibroin with poly(ethylene oxide). *Biomacromolecules* (2004), 5(3): 711-717, the contents of which are incorporated entirely herein by reference. The silk fibroin/PEO blends are gently mixed at room temperature using a spatula before sonication for ten minutes. Silk/PEO tubes may be formed using a dual syringe technique as described previously, with varied silk/PEO blend concentrations in either syringe allowing finer control of silk tube porosity. After drying, the silk/PEO tubes are immersed in distilled water for 24 hours at room temperature to facilitate the extraction of the PEO phase from the silk/PEO tube.

Composite silk tubes may be generated by the successive deposition of silk fibroin in multiple winding angles and/or multiple post-winding processing treatment steps. For example, a composite tube may be formed with a lyophilized middle section flanked by two crisscrossed sections on either end, with the entire construct wrapped in a final silk layer. Such a composite tube combines the cell-seeding ability of the porous lyophilized center with the ability to cannulate and suture the tube with the patterned, methanol-treated section. Moreover, the final methanol-treated wrapping of the tube enhances the overall structure and stability of the tube. In general, aspects of the present invention enable the generation of composite silk tubes with spatially defined pores and mechanical properties.

To examine composite tubes with different winding patterns and post-winding processing, fluorescently labeled protein, dextran, or microspheres may be employed to enable visualization of each layer deposited. For example, in one study, two different molecular weight dextrans (2,000,000 MW, tetramethylrhodamine-conjugated; 10,000 MW, Cascade Blue-conjugated) and BSA (66,000 MW, AlexaFluor-488-conjugated) were mixed with the silk solution prior to winding, and minimal leaching between layers was observed after post-winding processing. Composite silk tubes were prepared with up to three independent deposition layers where each layer of silk contained a different molecule of interest. Alternatively, fluorescent microspheres (10 μm diameter) in three different colors may be used to visualize the windings and layers of silk of a particular tube.

In further study, mechanical properties of the tubes were assessed using tensile testing to determine the elastic modulus, yield strength, ultimate tensile strength, and elongation to failure. The methanol-treated and air-dried tubes exhibited the greatest mechanical strength with elastic moduli of 8.35±2.59 MPa and 9.56±0.94 MPa, respectively. Similar trends were seen for the ultimate tensile strength as mean values of 1.12±0.32 MPa for the methanol-treated tubes and 1.74±0.33 MPa for the air-dried tubes were observed. These results indicate that the methanol-treatment and air-drying enhanced the overall protein assembly, β-sheet formation, and shear alignment that provide the mechanical strength of the tubes. See, e.g., a Jin H. J. et al. Bioprocessing of Silk Proteins—Controlling Assembly. in: *Bionanotechnology* (Springer, Netherlands, 2006), pp. 189-208. The lyophilized tubes, on the other hand, were softer, demonstrating an elastic modulus and ultimate tensile strength of 2.20±0.90 MPa and 0.27±0.11 MPa, respectively. Considering the elongation to failure, values of 46.5±17.1%, 55.5±10.2%, and 27.5±10.9% were recorded for methanol-treated, air-dried, and lyophilized tubes, respectively. In comparison with the mechanical properties of the human saphenous vein, the current standard for arterial bypass grafts, the properties of the silk tubes were on the same order of magnitude as those of the native tissue. See, e.g., Bia Santana, D. et al. Functional properties of fresh and cryopreserved carotid and femoral arteries, and of venous and synthetic grafts: comparison with arteries from normotensive and hypertensive patients. *Cell Tissue Bank* (2006), 8:43-57; Han, D. W. et al. Long-term preservation of human saphenous vein by green tea polyphenol under physiological conditions. *Tissue Eng* (2005), 11:1054-1064; and Donovan, D. L. et al. Material and structural characterization of human saphenous vein. *J Vasc Surg* (1990), 12:531-537, the contents of these publications being incorporated entirely herein by reference. In addition, fabricated silk tubes using both electrospun and aqueous-dipping methods have demonstrated sufficient radial mechanical properties and burst pressures to maintain the physiological stresses imparted by blood pressure. See, e.g., Lovett, M. et al. Silk fibroin microtubes for blood vessel engineering. *Biomaterials* (2007), 28:5271-5279; and Soffer, L. et al. Silk-based electrospun tubular scaffolds for tissue-engineered vascular grafts. *Journal of Biomaterials Science, Polymer Edition* (2008), 19:653. This overall property matching has significance, as elasticity and compliance mismatch are two of the primary causes of thrombosis in currently available synthetic bypass grafts. See, e.g., Hoenig, M. R. et al. Tissue-engineered blood vessels: alternative to autologous grafts? *Arterioscler Thromb Vasc Biol* (2005), 25:1128-1134. However, while the biomechanical properties did nearly match those of a human vein, this system affords more precise control through the use of different winding angles, additional layering, and/or varied post-processing, specifically in the generation of composite tubes, thus providing a technique for dictating biological response in vitro and in vivo for each specific application.

In yet further study, human coronary artery smooth muscle cells (HCASMCs) and a GFP-expressing line of human umbilical vein endothelial cells (GFP-HUVECs) were used to seed silk tubes. See, e.g., Lovett, M. et al. Silk fibroin microtubes for blood vessel engineering. *Biomaterials* (2007), 28:5271-5279; and Zhang, X. et al. In vitro evaluation of electrospun silk fibroin scaffolds for vascular cell growth. *Biomaterials* (2008), 29:2217-2227, the contents of which are incorporated entirely herein by reference. Prior to seeding, the cells were cultured according to previously reported protocols where GFP-HUVECs were grown in optimized growth media EGM-2 (Lonza, Walkersville, Md.) supplemented with 100 U/mL penicillin, 1000 U/mL streptomycin, and 0.2% fungizone antimycotic (GIBCO, Carlsbad, Calif.), and HCASMCs were cultured in smooth muscle cell medium (SMCM) with 2% fetal bovine serum (FBS), 1% smooth muscle cell growth supplement, and 1% penicillin/streptomycin solution (ScienCell Research Laboratories, Carlsbad, Calif.). Prior to cell seeding, HCASMCs were stained using a red CellTracker dye at a concentration of 10 μM according to company protocols (Invitrogen, Carlsbad, Calif.).

The silk tubes were seeded using a bioreactor system described by Lovett, M. et al. Silk fibroin microtubes for blood vessel engineering. *Biomaterials* (2007), 28:5271-5279. Silk tubes were hydrated and sterilized using distilled water and ethanol, respectively, before inserting into the bioreactor, spanning two 19 gauge needles with media added to pre-condition the tubes. Red HCASMCs were injected into the tube at a concentration of $5\times10^6$ cells/mL using a syringe and cultured for 3-4 days before adding GFP-HUVECs. GFP-HUVECs were injected into the silk tube in the same manner as the HCASMCs, at a concentration of $5\times10^6$ cells/mL, and cultured for an additional day before imaging using confocal microscopy. Both cell types attached to the lumen of the tube and were visualized using confocal microscopy. This cell attachment indicates the ability to culture functional tissue-engineered vascular grafts in vitro prior to in vivo implantation. Further control of cell attachment can be controlled through the attachment of cell binding motifs such as RGD-peptides or other functional molecules as described by Sofia, S. et al. Functionalized silk-based biomaterials for bone formation. *J Biomed Mater Res* (2001), 54:139-148, the contents of which are incorporated entirely herein by reference. Control of cell attachment may provide additional design criteria for tailoring spun silk tubes for specific tissue engineering applications.

Furthermore, silk tubes may be loaded with bioactive molecules for drug release applications or the like. For example, in some studies, silk tubes have been loaded with paclitaxel and heparin to inhibit graft thrombosis when implanted.

In summary, aqueous biopolymer spinning represents a significant advance over current methods for production of tubular constructs, including dip methods for production of silk tubular constructs as well as other gel spinning methods used with other degradable polymer systems. Furthermore, it differs from current artificial silk spinning techniques such as wet spinning, where fibers are typically drawn into a methanol coagulation bath, and electrospinning, where a polymer solution is subjected to a high voltage electric field to generate nanoscale fibers. See, e.g., Phillips, D. M. et al. Regenerated silk fiber wet spinning from an ionic liquid solution. *J Mater Chem* (2005), 15:4206-4208; Ha, S. W. et al. Structural studies of Bombyx mori silk fibroin during regeneration from solutions and wet fiber spinning. *Biomacromolecules* (2005), 6:1722-1731; Trabbic, K. A. et al. Comparative structural characterization of naturally- and synthetically-spun fibers of Bombyx mori fibroin. *Macromolecules* (1998), 31:462-471; and Liivak, O. et al. A microfabricated wet-spinning apparatus to spin fibers of silk proteins. Structure-property correlations. *Macromolecules* (1998), 31:2947-2951, the contents of these publications being incorporated entirely herein by reference. According to aspects of the present invention, fibers are generated from viscous, concentrated silk solutions through the shear forces applied by a small gauge needle. Thus, embodiments according to the present invention provide different winding and post-winding processing options that are not available using the other artificial silk spinning approaches. In addition, aspects of the present invention mimic the natural biochemistry of the silkworm spinneret where issues of fibroin concentration, gelation, and shear are critical parameters for silk spinning. See, e.g., Asakura, T. et al. Some observations on the structure and function of the spinning apparatus in the silkworm Bombyx mori. *Biomacromolecules* (2007), 8:175-181; and Jin, H. J. et al. Mechanism of silk processing in insects and spiders. *Nature* (2003); 424:1057-1061. Indeed, this technique may be combined with the others to further improve tube properties, such as the winding of fibers to improve mechanical strength or with the addition of cells directly into the matrix for more specific biological outcomes. The use of an all aqueous process according to aspects of the present invention allows for the incorporation of labile biological components from growth factors to cells, as demonstrated with other modes of silk processing Li, C. et al. Electrospun silk-BMP-2 scaffolds for bone tissue engineering. *Biomaterials* (2006), 27:3115-3124; and Wang, X. et al. Nanolayer biomaterial coatings of silk fibroin for controlled release. *J Control Release* (2007), 121: 190-199, the contents of which are incorporated entirely herein by reference. This establishes unique options for the system to bioengineer tubular scaffolds for a range of biological control, while at the same time exploiting the novel mechanical and biological properties of silk proteins, for a variety of applications.

Although the embodiments described herein may be directed to the spinning of silk fibroin to form tubular structures, it is understood that embodiments according to aspects of the present invention may spin other biomaterials, such as collagen and/or fibrin, to form spun biomaterial composites. For example, the liquid spinning approach may be applied to these other biomaterials and deposited, with or without cells such as endothelial cells or smooth muscle cells, in a stepwise layer-by-layer fashion to generate a composite tissue-engineered blood vessel. A collagen solution may include 2.5 mg/mL collagen, while a fibrin solution may include 5 mg/mL fibrin. As described previously, these solutions may be delivered through a needle of a syringe, e.g., the first syringe 115, onto a rotating and axially reciprocating mandrel 110 to produce the desired pattern. In particular, porosity and thickness of each layer is controlled by varying the axial slew rate and rotation of the mandrel 110 in addition to the spinning time, which corresponds to the number of layers of material deposited on the mandrel 110.

Collagen hydrogels and fibrin hydrogels may be prepared according to techniques in the literature. For example, collagen hydrogels may be prepared, with minor changes, according to a technique by Lewus, K. E. et al. In vitro characterization of a bone marrow stem cell-seeded collagen gel composite for soft tissue grafts: effects of fiber number and serum concentration. *Tissue Eng* (2005), 11(7-8):1015-1022, the contents of which are incorporated entirely herein by reference. In particular, collagen gels may be prepared on ice by mixing 1.22 mL type I rat tail liquid collagen (~4 mg/mL in 0.02 N scetic acid) (Upstate Cell Signaling Solutions, Lake Placid, N.Y.), 12.2 μL 2 M sodium hydroxide, 20 μL 100 mM ascorbic acid, and 768 μL of growth medium for a final collagen concentration of approximately 2.5 mg/mL. See, e.g., Wang, Y. et al. In vitro cartilage tissue engineering with 3D porous aqueous-derived silk scaffolds and Mesenchymal stem cells. *Biomaterials* (2005), 26(34):7082-7094, the contents of which are incorporated entirely herein by reference. This collagen suspension may be aliquotted in 400 μL volumes into each well of the bioreactor and maintained at 25° C. for 15-30 minutes to allow for even gelation before being placed in the incubator. For long-term experiments, 200 μL of growth medium may be added to the top of each gel after 1-2 hours.

Moreover, although the embodiments described herein may be directed to the formation of tubular structures applicable to microvasculature, it is understood that other embodiments may be applied in other areas of tissue engineering, such as intervertebral discs, nerve guides, and other complex composite scaffolds. In addition, applications external to tissue engineering are many and include advanced textiles for use in biodegradable soft-bodied robots. These and other applications are served by the ability to wind material around non-uniform shapes, such as a bladder, branched artery, or trachea. In general, embodiments of the present invention are not limited to forming substantially tubular structures and may form more complex shapes. To increase output, the number of syringes may be increased and eventually interfaced with a robotics platform to even finer control of material deposition. Moreover, to form more complex shapes for the biomaterial structure, the relative motion between the support structure (e.g., the mandrel 110) and the applicator(s) of the biomaterial (e.g., the first syringe 115 and the second syringe 125) is not limited to only moving the support structure. The relative motion between the support structure and the applicator(s) can be alternatively or additionally caused by movement of the applicator(s). For example, an embodiment may couple one or more motors to the applicator(s) and cause the applicator(s) to move relative to the support structure. Another embodiment may couple the applicator(s) to a secondary guide structure that minors the shape of the support structure and that turns with another motor, so that movement of the applicator(s) follows the secondary guide structure and corresponds with the shape and rotation of the support structure. In general, spinning of materials, such as aqueous silk, provides a substantial improvement with many applications in tissue engineering and beyond.

While the present invention has been described in connection with a number of exemplary embodiments, and implementations, the present inventions are not so limited, but rather cover various modifications, and equivalent arrangements.

What is claimed is:

1. A method for making a silk device, the method comprising steps of:

applying a solution of silk fibroin via an applicator to a support structure that is reciprocating and rotating relative to the applicator, so that the silk fibroin wraps around the support structure; and inducing transformation of the silk fibroin from amorphous liquid to β-form silk characterized by anti-parallel β-sheets, so that the silk device is formed.

2. The method of claim 1, wherein the support structure is a mandrel, so that the silk device is substantially tubular.

3. The method of claim 1, wherein the support structure has an irregular shape.

4. The method of claim 1, wherein the relative reciprocating and rotating is achieved via means through which rate of reciprocation and/or of rotation is adjusted.

5. The method of claim 1, wherein the solution further comprises another biomaterial.

6. The method of claim 1, wherein the another biomaterial is selected from the group consisting of collagen, fibrin, and combinations thereof.

7. The method of claim 1, wherein the another biomaterial is selected from the group consisting of silk, collagens, fibrin, chitin, chitosan, polyhydroxyalkanoates, elastin, resilin, cellulose, polylactic acid, polyglycolic acid and combinations thereof.

8. The method of claim 1, wherein the silk solution contains about 15% to about 25% silk.

9. The method of claim 1, wherein the silk solution contains about 20% to about 35% silk.

10. The method of claim 1, wherein the relative rotation is at a speed within the range of about 0 to about 1000 rpm.

11. The method of claim 1, wherein the relative reciprocation is at an axial speed within the range of about 0 to about 100 mm/s.

12. The method of claim 1, further comprising repeating the steps of applying and inducing so that a multi-layer silk device is formed.

13. The method of claim 12, wherein different layers of the multi-layer silk device have different thicknesses.

14. The method of claim 1, wherein the silk device is patterned.

15. The method of claim 12, wherein at least one layer of the multi-layer silk device is patterned.

16. The method of claim 1, wherein at least one of the steps of applying and inducing comprises introducing porosity into the silk device.

17. The method of claim 1 or claim 12, further comprising a post-processing step performed after at least the step of applying, which post-processing step is selected from the group consisting of: step of lyophilizing, air-drying, treating with methanol, treating with nitrogen gas, and combinations thereof.

18. The method of claim 1 or claim 12, further comprising a step of incorporating an active agent into the device.

* * * * *